US005899099A

United States Patent [19]

Tsai

[11] Patent Number: 5,899,099

[45] Date of Patent: May 4, 1999

[54] COMBINATION LOCK

[76] Inventor: Cheng-Tao Tsai, No. 80, Lane 151, Te Tung Street, Tainan, Taiwan

[21] Appl. No.: 09/090,525

[22] Filed: Jun. 4, 1998

[51] Int. Cl.[6] ..... E05B 37/06

[52] U.S. Cl. ..... 70/26; 70/30; 70/312

[58] Field of Search ..... 70/30, 49, 26, 70/23, 15, 18, 303 A, 303 R, 312, 315–318

[56] References Cited

U.S. PATENT DOCUMENTS

| | | | |
|---|---|---|---|
| 200,617 | 2/1878 | King et al. | 70/30 |
| 226,069 | 3/1880 | Hathaway | 70/18 X |
| 879,747 | 2/1908 | Crim et al. | 70/18 X |
| 1,021,456 | 3/1912 | Evans | 70/26 |
| 1,468,027 | 9/1923 | Lindberg | 70/23 |
| 1,551,952 | 9/1925 | Hanflig | 70/26 |
| 1,777,424 | 10/1930 | Atkins | 70/26 |
| 2,018,745 | 10/1935 | Schlitz | 70/23 X |
| 3,999,408 | 12/1976 | Kawakami | 70/18 |
| 4,302,955 | 12/1981 | Kawakami | 70/30 |
| 5,027,623 | 7/1991 | Ling | 70/26 |
| 5,636,539 | 6/1997 | Tsai | 70/30 X |
| 5,749,251 | 5/1998 | Keefe | 70/30 |

*Primary Examiner*—Suzanne Dino Barrett
*Attorney, Agent, or Firm*—Rosenberg, Klein & Bilker

[57] ABSTRACT

A combination lock includes a female member, a number disc, a plurality of activate rings, a plurality of cushions, a plurality of toothed rings, a housing and a male member. The number disc, the activate rings, the cushions and the toothed rings are sequentially inserted on a cylinder of the female member and with the exception of the number disc, are contained in the housing. Then the number disc is rotated clockwise and counterclockwise, with the snap means of the number disc moving a first snap means of a first toothed ring and the second snap means of the first toothed ring moving a first snap means of a second toothed ring and so on. Such aligns the notches of all activate rings to form a passageway corresponding to the slot of the cylinder for insert of a rod with teeth of the male member. The lock is locked and unlocked by rotating only the number disc.

2 Claims, 7 Drawing Sheets

COMBINATION LOCK

BACKGROUND OF THE INVENTION

This invention relates to a combination lock. Particularly, the present invention has a number disc for setting a code of several digits for locking and unlocking.

A small light lock is generally used with a chain for preventing a bicycle or motorcycle from being stolen. Nowadays, combination locks are widely used for this purpose, to avoid embarrassment of losing a key or breaking a key in the key hole, and for convenience of use.

A conventional combination lock, shown in FIG. 11, includes a male member 10, and a female member 20. The male member 10 has a long rod 101 and plurality of teeth 102 formed on the rod 101. The female member 20 has a cylinder 201, and several number discs 202 and spring discs 203 are secured by a C-shaped locking ring 204 positioned in an annular groove 205 of the female member 20. After the number discs 202 and the spring discs 203 are assembled with he female member 20, a central keyway-shaped passageway is formed for the rod 101 with the teeth 102 of the male member 10 to be received therein.

In the case where the conventional combination lock is to be locked, the number discs 202 are rotated to the preset number used to unlock the lock, so that the center passageway is formed in the female member 20 and the male member 10 can extend into the cylinder 201 of the female member 20. After that, the number discs 202 are rotated to any number, except that used for unlocking, to lock the male member in the female member and make it impossible to be pulled out. If the number lock is to be unlocked, the number discs 202 are rotated to the preset number to establish the unlocking position.

However, the conventional combination lock includes many sets of number discs representing a large portion of the cost of the lock, the total cost of the lock thereby being high. In addition, the number discs have a rather large dimension, making the whole lock less handy to use.

SUMMARY OF THE INVENTION

The main purpose of the invention is to provide a combination lock, which includes a number disc and a plurality of activate rings, cushions, and a plurality of toothed rings sequentially assembled around a cylinder of a female member. All of the components, except the number disc, fitting around the cylinder are contained in a housing with one end connected to one end of a wire rope. Then a male member with a long rod having teeth is inserted into the cylinder after the number disc is rotated to align all notches of the activate rings and the cushions to establish a lengthwise slot so as to permit the male member to be inserted in the cylinder of the female member. Then, the number disc is rotated to force the bodies of some or all of the notches of the activate rings and the cushions to not be aligned, so as to prevent the male member from being pulled out of the female member. In other words, the combination lock is locked by non-alignment of the activate rings and the cushions subsequent to insertion of the male member into the female member.

BRIEF DESCRIPTION OF THE DRAWINGS

This invention will be better understood by referring to the accompanying drawings, wherein.

DETAILED DESCRIPTION OF THE PREFERRED EMBODIMENT

Figures 1, 2:
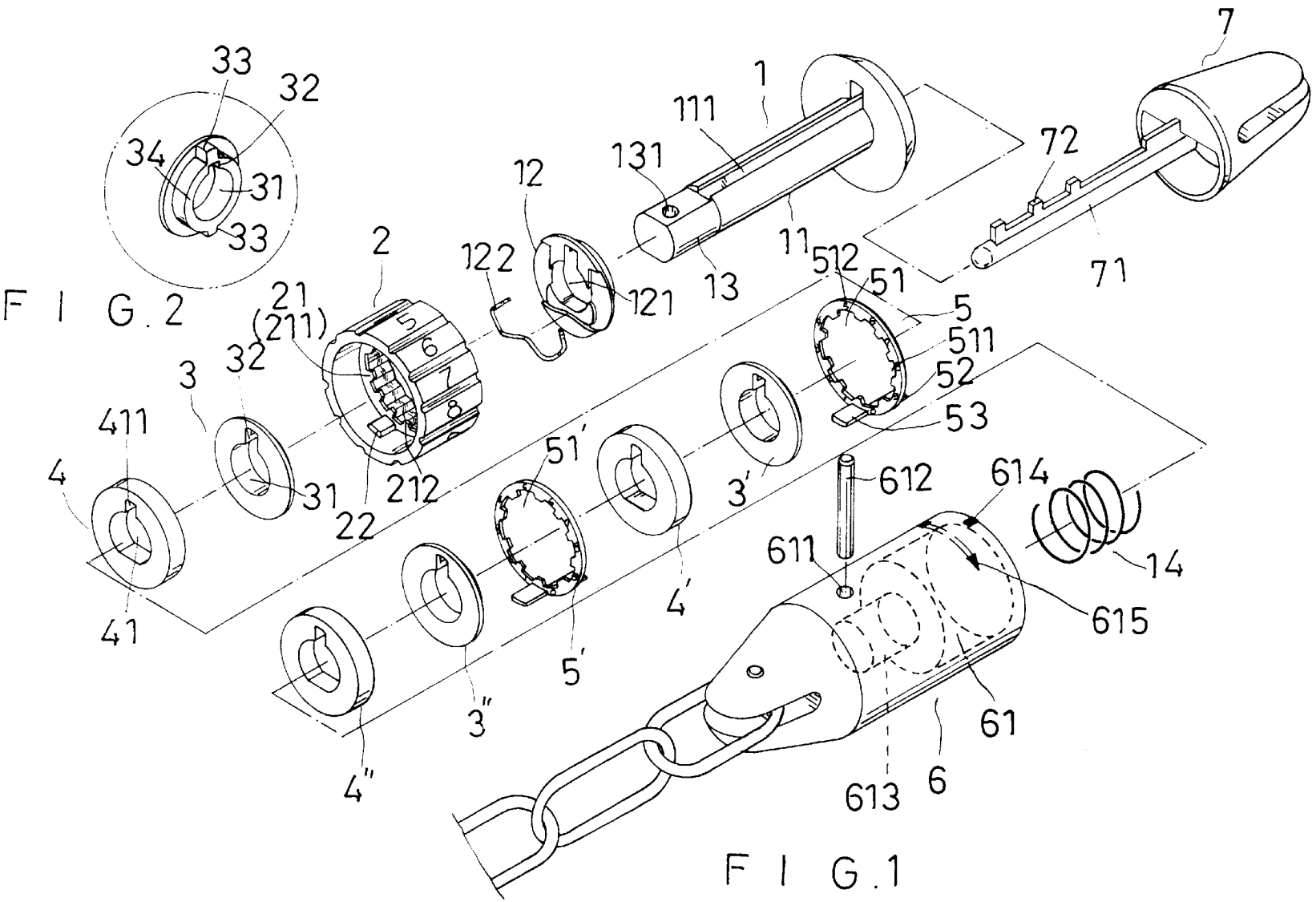
FIG. 1 is an exploded perspective view of a combination lock of the present invention.
FIG. 2 is a perspective view of an activate ring of the present invention.

A preferred embodiment of a combination lock of the present invention, as shown in FIG. 1, includes a female member 1, a number disc 2, a plurality of activate rings 3, 3', 3", a plurality of cushions 4, 4', 4", a plurality of toothed rings 5, 5', 5", a housing 6, and a male member 7.

The female member 1 has a cylinder 11, a secure ring 12 and a secure spring 122, both securely fitting around the cylinder 11. A lengthwise slot 111 is formed in an upper side of the cylinder 11, and an inner insert end 13 of cylinder 11 is formed with a pin hole 131. The number disc 2, the activate rings 3, 3', 3", the cushions 4, 4', 4", and the toothed rings 5, 5', 5" are assembled on the cylinder 11 and a spring 14 is fit around the inner insert end 13.

The number disc 2 has a center hole 21, a plurality of engage notches 211 formed continuously in spaced apart relationship around an inner wall that defines the center hole 21. The notches 211 correspond respectively to a plurality of figures marked on an outer surface of the number disc 2. A snap means 22 is provided on the inner wall at a predetermined location. The number disc 2 further has a plurality of secure projections 212 spaced apart on the inner wall for contact with the secure ring 12 and provide a sound when the number disc 2 is rotated.

Each of the activate rings 3, 3', 3" (a first, a second, a third) respectively have a center hole 31, 31', 31" that is fit on the cylinder 11 of the female member 1. Each ring has a notch 32, 32', 32" on top of the hole 31 and two opposite projections 33, 33', 33" on an upper and a lower edge of the center hole 31, 31', 31". An annular projecting wall 34, 34', 34" is formed on each activate ring, defining the center hole and fitting in an inner edge of the center hole 21 of the number disc 2 or the center hole 51 of the toothed ring 5, as shown in FIG. 2.

The cushions 4, 4', 4" (a first, a second, a third) each respectively have a keyway-shaped center secure hole 41, 41', 41" with a notch 411, 411', 411" at a top of the center secure hole 41, 41', 41". Each cushion fits on the cylinder 11 of the female member 1, and does not rotate. The notch 411, 411', 411" is always positioned in the same direction.

Each toothed ring 5, 5', 5" (a first, a second, a third) respectively has a center hole 51, 51', 51" corresponding to the center hole 21 of the number disc 2, a plurality of engage notches 511, 511', 511" formed around an inner wall thereof and corresponding to the engage notches 211 of the number disc 2. FIGS. 512 are marked around a circumferential edge of an outer surface of the toothed ring to coordinate with those of the number disc 2. Further, a first and a second snap means 52, 52', 52" and 53, 53', 53" are provided to extend sidewise from opposite sides of the wall, in alignment with a notch 511.

The housing 6 has a hollow chamber 61, and a pin hole 611 through a wall thereof in open communication with the chamber 61, with a pin 612 passing through the 611 and 131 to secure the female member 1 to the housing 6. The housing 6 further has a secure hole 613 extending inwardly from the chamber 61 for receiving the inner insert end 13 of the female member 1 therein. A mark 614 and two directional arrows 615 are printed on an outer surface of the housing 6 near an opening of the chamber 61. The end of the housing 6 opposite the opening of the chamber 61 is connected to a wire rope or a chain.

The male member 7 has a long rod 71, several teeth 72 spaced apart on the rod 71. The male member 7 has an outer end connected with the other end of the wire rope or chain, and the rod 71 fits into the cylinder 11 of the female member 1.

Figure 4:
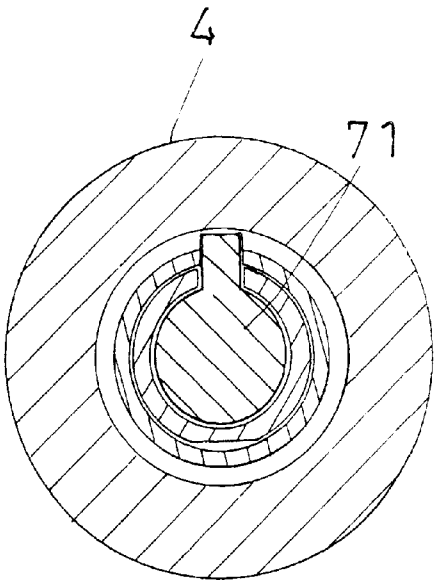
FIG. 4 is a side cross-sectional view of the present invention.
Figure 3:
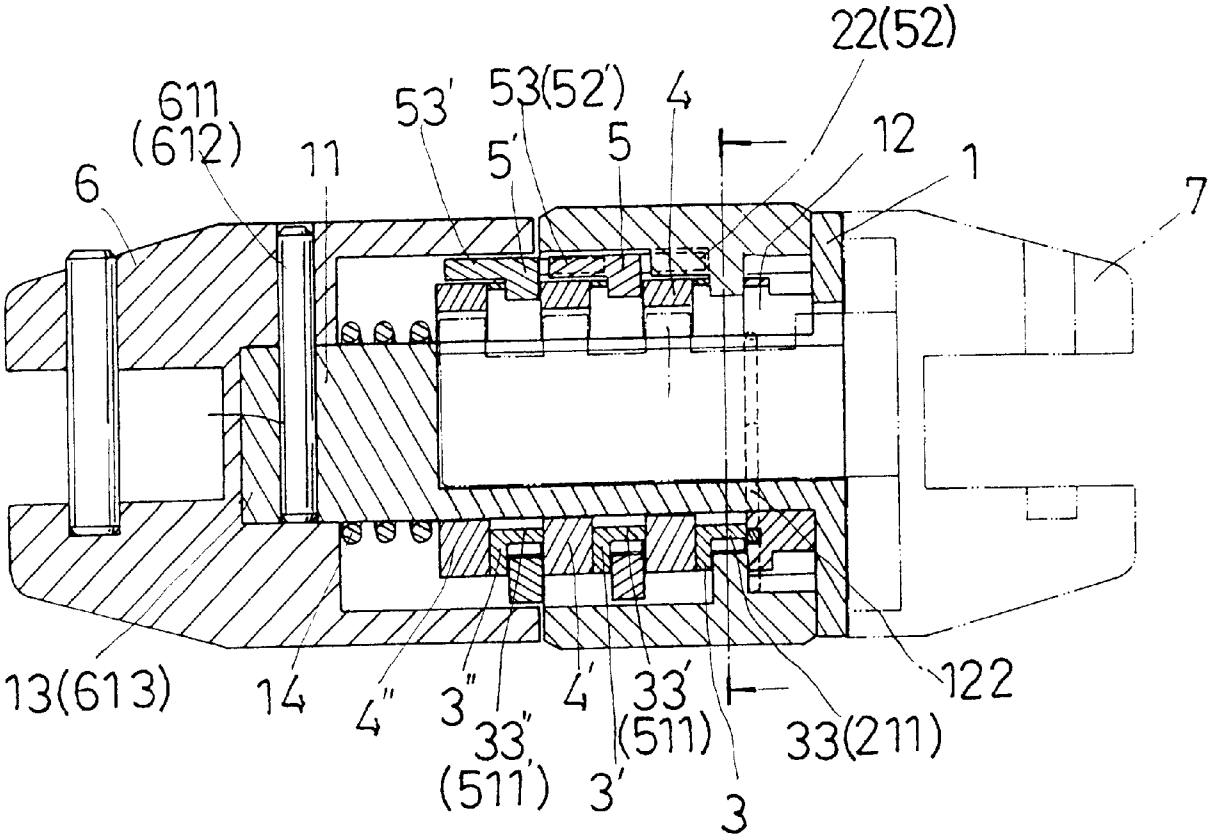
FIG. 3 is a cross-sectional view of the present invention.
Figure 5:
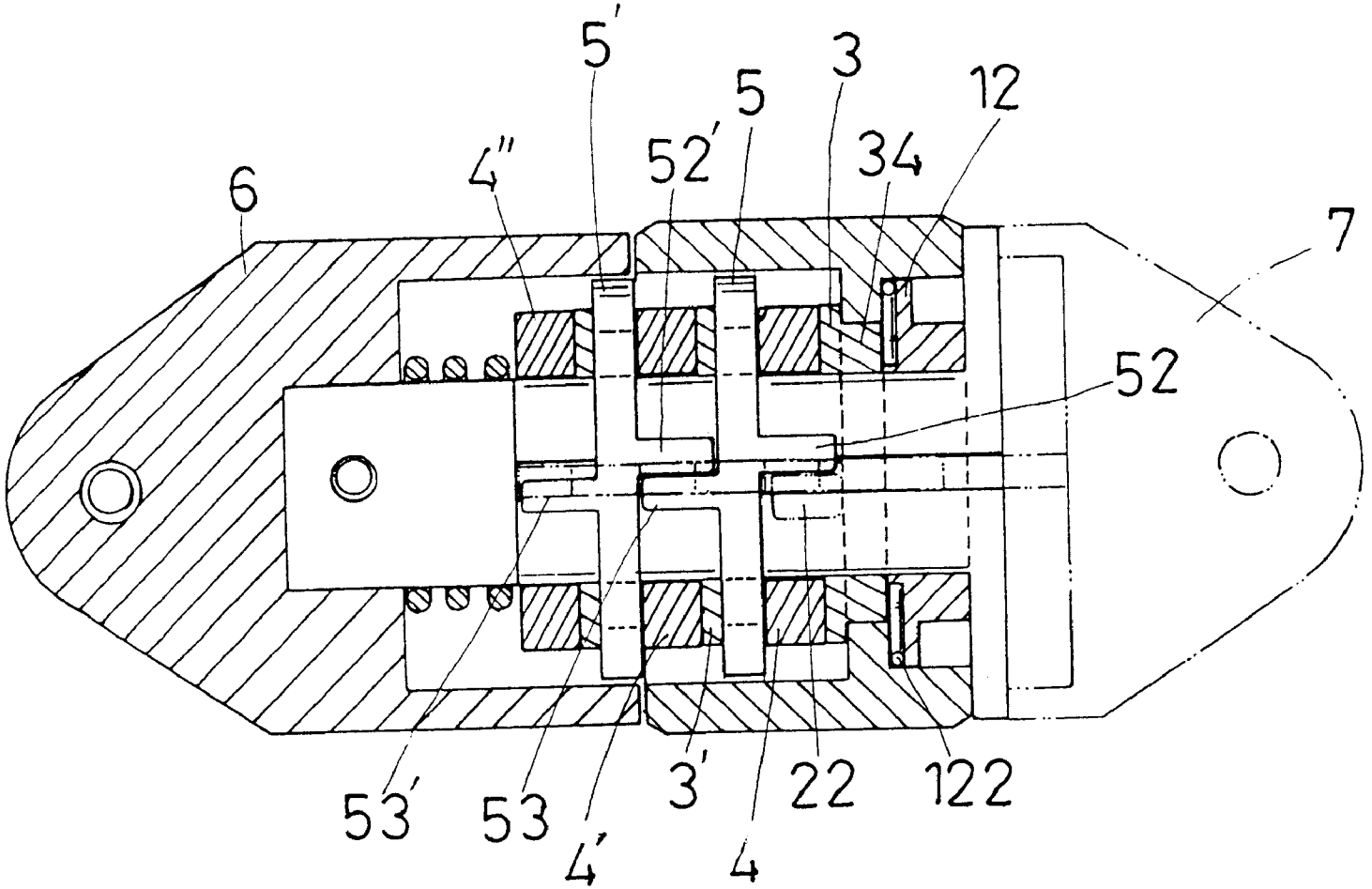
FIG. 5 is an upper cross-sectional view of the present invention.

In assembly the lock, with reference to FIGS. 3, 4 and 5, the secure ring 12, the number disc 2 and the first activate ring 3 are first sequentially installed on the cylinder 11, with the projecting wall 34 of the first activate ring 3 fitting in the inner wall defining the center hole 21, and with the projections 33 fitting in a respective two of the notches 211 of the number disc 2. In this position, the notches 211 of the number disc 2 not only correspond to the notch 32 of the activate ring 3, but are closed by the body of the activate ring 3. The number disc 2 fits securely around the cylinder 11, with a figure formed on the outer surface of the number disc 2 in alignment with the notch 32 of the activate ring 3.

Next, the first cushion 4 is inserted on the cylinder 11 and secured in place. Then, the first toothed ring 5 is inserted on the cylinder 11 with the first snap means 52 of the first toothed ring 5 located to abut the snap means 22 of the number disc 2. Next, the second activate ring 3' is inserted on the cylinder 11, with the projecting wall 34' contacting the inner wall of the center hole 51 of the first toothed ring 5, and with the projections 33' engaging two corresponding notches 511. In this position, the notches 511 of the toothed ring 5 not only correspond to the notch 32' of the second activate ring 3', but are closed by the body of the second activate ring 3'. At this time, the notch 32' may correspond to the FIG. 512 of the first toothed ring 51 and not correspond to the digit represented by the notch 32 of the first active ring 3, to become the second digit of the combination. Then the first activate ring 5 is secured on the cylinder 11.

Further, the second cushion 4' is inserted on the cylinder 11 and positioned in its place adjacent the second activate ring 3', and the second toothed ring 5' is inserted on the cylinder 11. The first snap means 52' of the second toothed ring 5' is located to abut the second snap means 53 (located opposite to the first snap means 52 of the toothed ring 5). Next, the third activate ring 3" is inserted on the cylinder 11, with the projecting wall 34" contacting the inner wall of the center hole 51' of the second toothed ring 5', and with the two projections 33' engaging two of the notches 511'. Then, the notches 511' of the center hole 51' of the second toothed ring 5' not only correspond to the notches 32" of the third activate ring 3", but are closed by the body of the third activate ring 3". The notch 32" of the third activate ring 3" corresponds to the FIG. 512' of the second toothed ring 5', becoming the third preset digit of the combination, but not a digit that is one less than the FIG. 512 on the first toothed ring 5. For example, if the digit of the first activate ring 3 is set as the numeral 3, the digit of the third activate ring 3" should not be set as the numeral 2. Then, the second toothed ring 5' is secured to the cylinder 11, and the third cushion 4" is inserted on the cylinder 11 and secured.

Next, the spring 14 is inserted on the cylinder 11 to abut the cushion 4". The housing 6, is placed over the activate rings 3, 3', 3", the cushions 4, 4', 4", and the toothed rings 5, 5', 5", with the inner insert end 13 of the female member 1 received in the secure hole 613. Then the pin hole 611 of the housing 6 is aligned with the pin hole 131 of the female member 1 for insert of the pin 612, to secure the female member 1 to the housing 6, protecting the components that are inserted on the cylinder 11.

Figure 6:
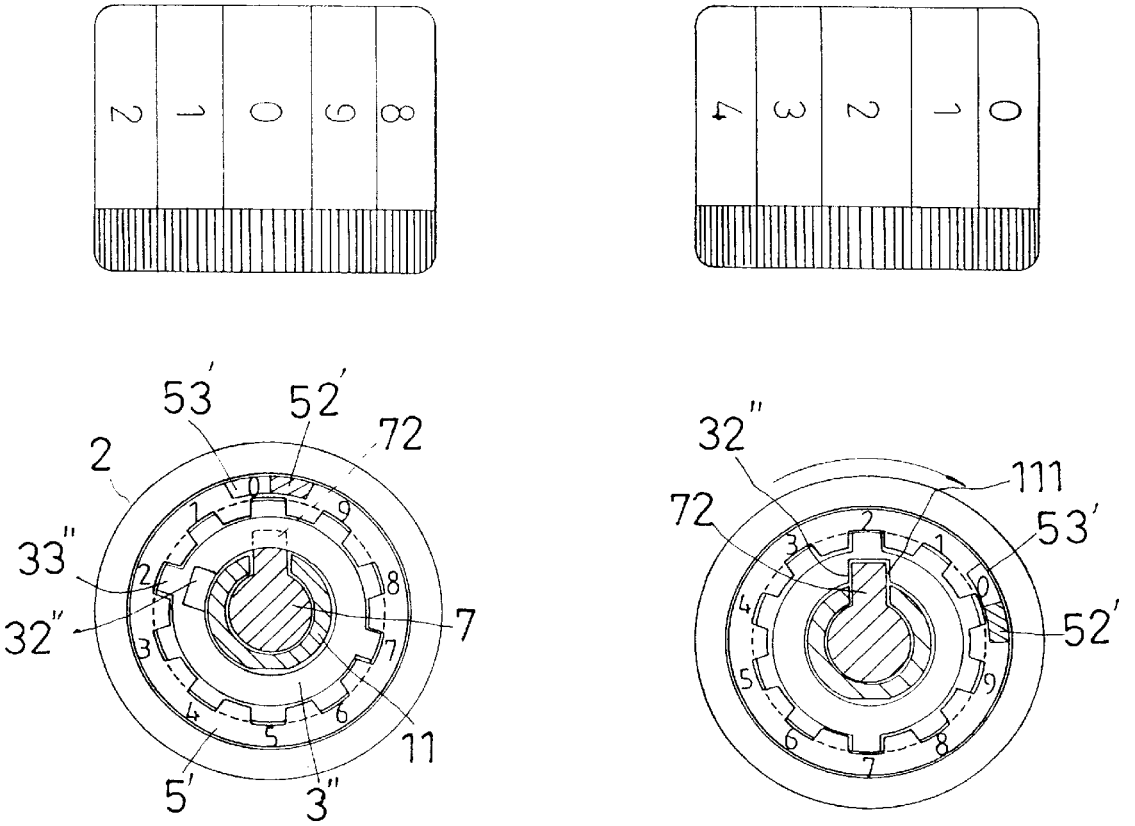
FIG. 6 is a side view of the number disc of the present invention being rotated at least three revolutions.
Figure 6:
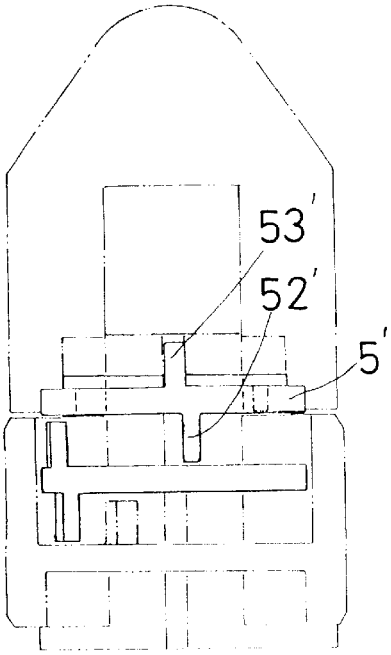
Figure 7:
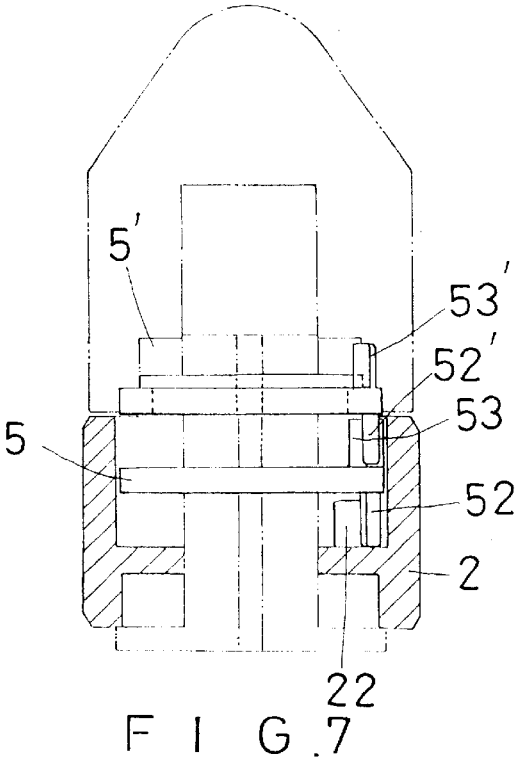
FIG. 7 is a side view of the number disc of the present invention being operated to rotate the number disc to align the preset number.

To use the combination lock, the number disc 2 is rotated clockwise for no less than three revolutions, letting the snap means 22 of the number disc 2 contact and move the first and the second snap means 52, 53, 52' of the first and the second toothed rings 5, 5' rotating the first and the second toothed rings 5, 5' as shown in FIG. 6. Then, the number disc 2 is rotated to the preset digit represented by the figure on the third activate ring 3", the snap means 22 moving the first snap means 52 and the second snap means 53 of the first toothed ring 5 moving the first snap means 52' of the second toothed ring 5'. When the second toothed ring 5' is rotated to the preset digit, the notch 32' of the second activate ring 3' forms a passageway corresponding to the slot 111 of the cylinder 11, as shown in FIG. 7.

Figure 8:
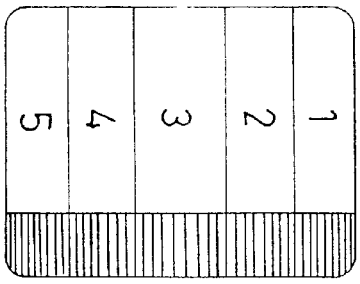
FIG. 8 is a side view of the number disc of the present invention being rotated counterclockwise for one revolution.
Figure 8:
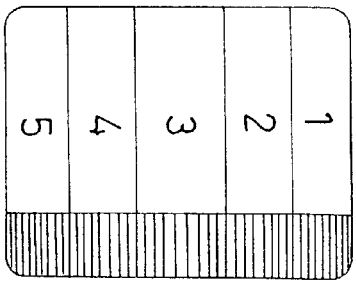
Figure 8:
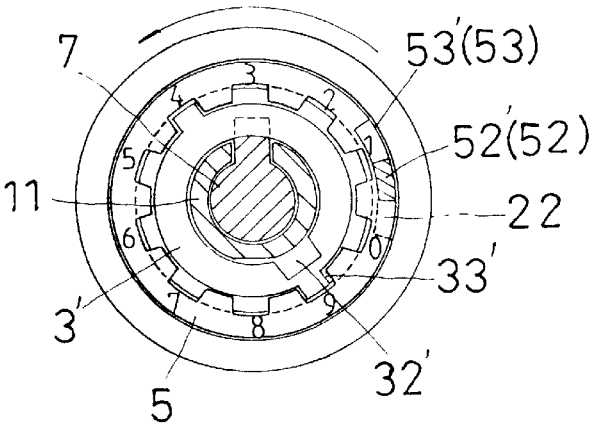
Figure 8:
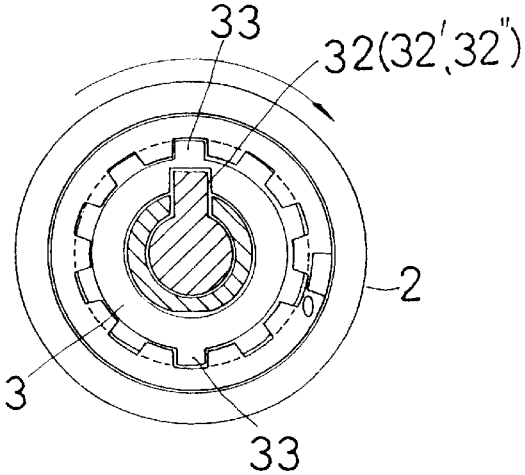
Figure 8:
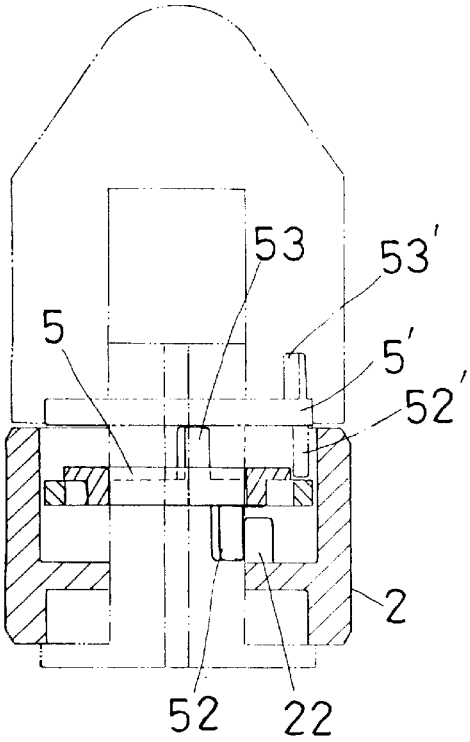
Figure 9:
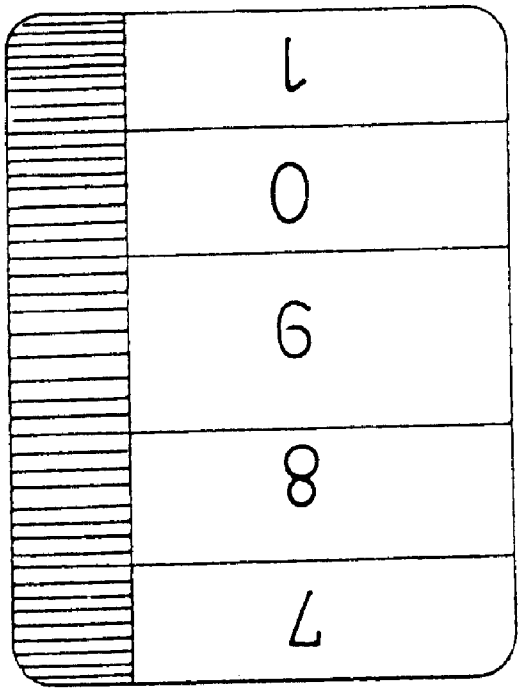
FIG. 9 is a side view of the number disc of the present invention rotated counterclockwise for two revolutions.
Figure 9:
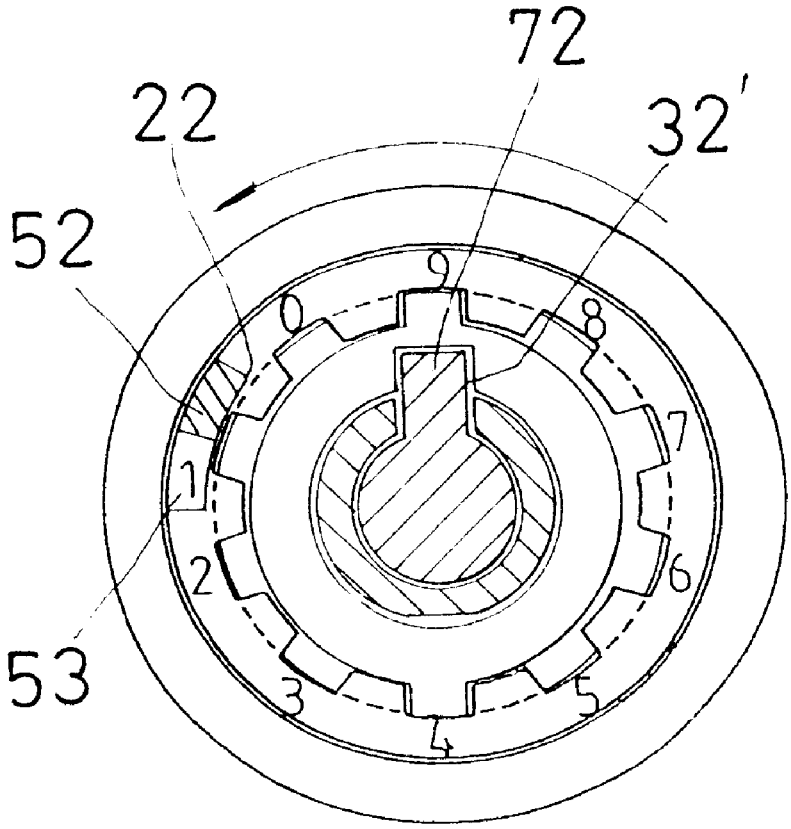
Figure 11:
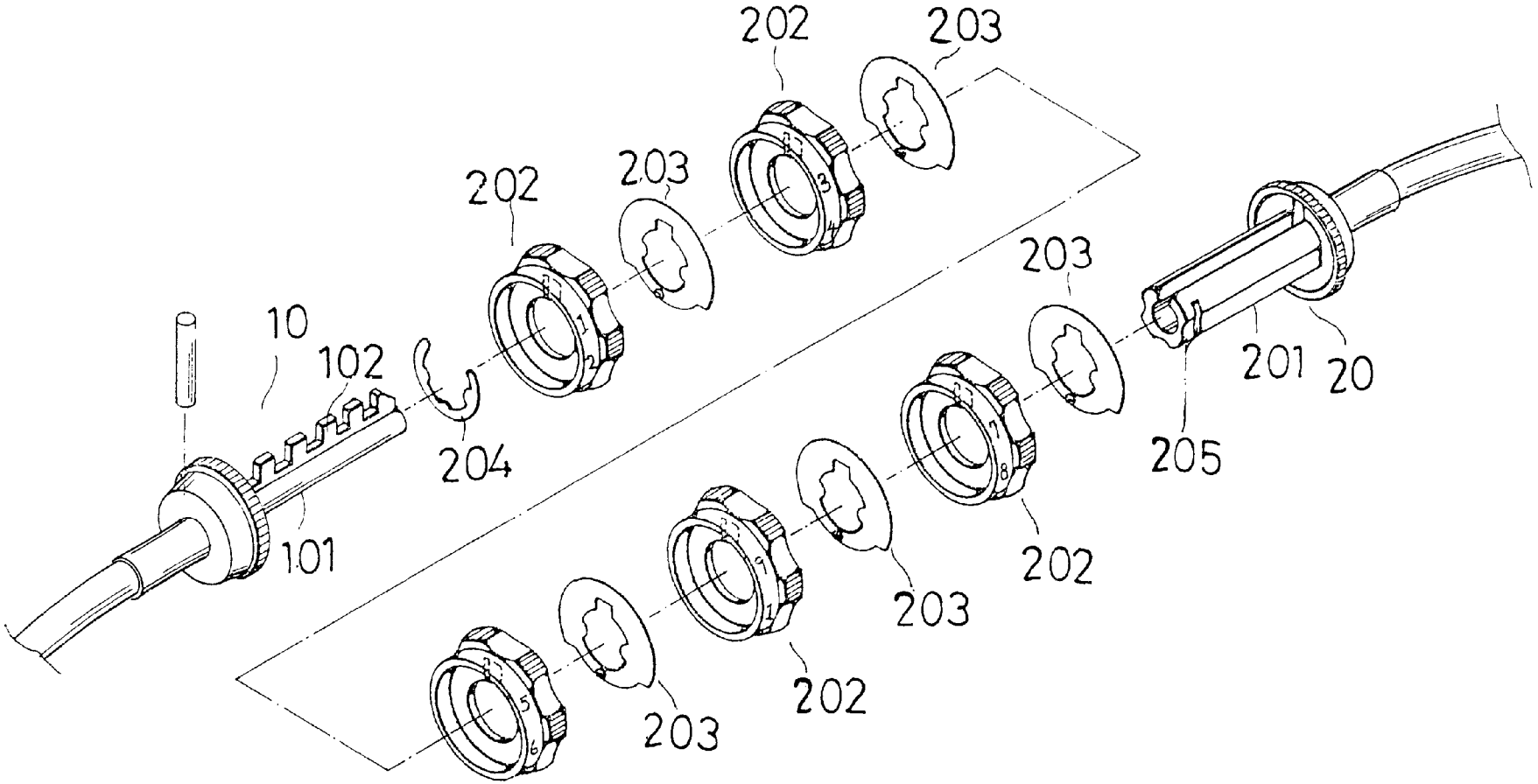
FIG.11 (PRIOR ART)

Next, the number disc 2 is rotated counterclockwise for a revolution, the snap means 22 moves the first and the second snap means 52, 53 of the first toothed ring 5 counterclockwise to separate the second snap means 53 from the first snap means 52' of the second toothed ring 5'. Then, the number disc 2 is rotated continuously until it reaches the preset digit of the first toothed ring 5 and the notch 32' of the activate ring 3' forms a passageway corresponding to the slot 111 of the cylinder 11, as shown in FIGS. 8 and 9.

Figure 10:
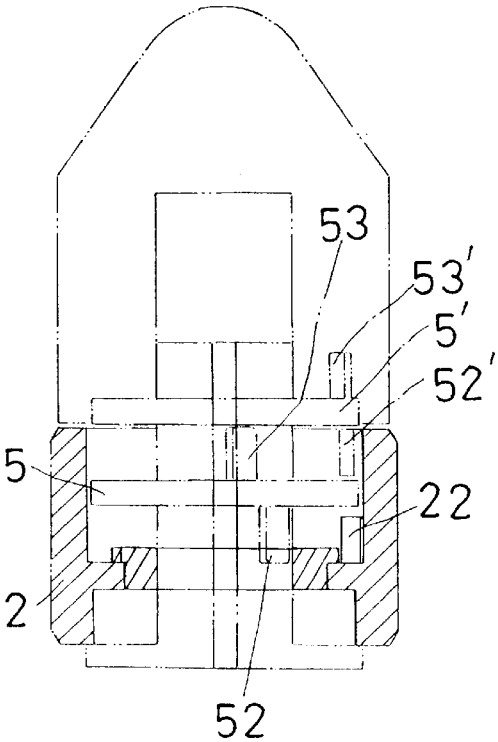
FIG. 10 is a side view of the number disc of the present invention being rotated clockwise until it is in the unlocked position; and, FIG. 11 is an exploded perspective view of a conventional combination lock.

Next, the number disc 2 is further rotated counterclockwise, the center hole 21 rotates the first activate ring 3 until the ring 3 moves to the preset digit of the number disc 2, so that the notch 32 of the first activate ring 3 forms a passageway corresponding to the slot 111 of the cylinder 11, as shown in FIG. 10. At this time, a keyway-shaped passageway is formed by the notches 32, 32', 32" of the activate rings 3, 3', 3" and the slot 111 of the cylinder 11, as shown in FIG. 10. At this time, the male member 7 can be inserted into the cylinder 11 of the female member 1. The number disc 2 is then rotated in any direction, causing the snap means 22 to move the means 52 and 53 and subsequently the bodies of the activate rings 3, 3', 3" disposed between the teeth 72 of the male member 7, so that the male member 7 can no longer be pulled out of the cylinder of the female member 1, locking the male member 7 in the female member 1. In other words, the combination lock is locked.

As understood from the above description, the combination lock of the invention can be locked or unlocked by rotating only a single digit carrying member. The combination lock is thereby easy to use, having only one number disc to handle in locking and unlocking the lock. This arrangement simplifies the components so that the cost of the lock can be lowered, and makes possible a minimization of the size of the lock.

While the preferred embodiment of the invention has been described above, it will be recognized and understood that various modifications may be made thereto and the appended claims are intended to cover all such modifications which may fall within the spirit and scope of the invention.

What is claimed is:

1. A combination lock comprising:

a female member having a cylinder provided with an upper lengthwise slot, a number disc, a plurality of activate rings, a plurality of cushions, a plurality of toothed rings, a housing, and a male member having a long rod provided with a plurality of teeth on an upper side thereof, said long rod extending in said cylinder of said female member, said male member having one end connected with one end of a wire rope, said number disc having its outer surface marked with a plurality of figures equally spaced thereon;

a secure ring being inserted on said cylinder of said female member and secured thereto by a secure spring, said cylinder having a round cap fixed to an outer end thereof;

said number disc having a center hole for insert on said cylinder of said female member, a plurality of notches equally angularly spaced on an inner wall defining said center hole, said number disc includes snap means formed on the inner wall at a predetermined location, said number disc having a plurality of secure projections formed on the inner wall;

each of said activate rings having (a) a center hole through which said cylinder of said female member passes therethrough, (b) a sidewise projecting wall defining said center hole of said activate ring, (c) a notch at a top portion of said activate ring center hole, and (d) two oppositely directed projections respectively on said notch and under a lower edge of said projecting wall, each said projecting wall having an annular end surface, said end surface of a first of said plurality of activate rings fitting into said center hole defined by said inner wall of said number disc;

each of said cushions having a center hole to fit securely on said cylinder of said female member, and a notch formed at a top portion of said cushion center hole;

each of said toothed rings having (a) a center hole corresponding to said center hole of said number disc, (b) a plurality of angularly spaced notches formed on an inner wall defining said center hole of said toothed ring, and (c) first and second snap means extending from opposing sides of said inner wall of said toothed ring in alignment with one of said notches; and, said housing having a hollow chamber opening to one side and containing said plurality of activate rings, said plurality of cushions and said plurality of toothed rings, wherein said number disc is rotated to rotate said notches of said plurality of toothed rings with respect to said notches of said plurality of activate rings for controlling passage of said long rod of said male member into and out of said slot of said female member for locking or unlocking said combination lock.

2. The combination lock as claimed in claim 1, wherein each of said toothed rings has a respective notch marked with a figure in correspondence with a respective figure marked on said number disc.

* * * * *